United States Patent [19]

Braun et al.

[11] Patent Number: 4,805,582

[45] Date of Patent: Feb. 21, 1989

[54] EXHAUST GAS RECIRCULATION VALVE

[75] Inventors: Charles W. Braun, Macedon; Joseph Fornuto; Dwight O. Palmer, both of Rochester, all of N.Y.

[73] Assignee: General Motors Corporation, Detroit, Mich.

[21] Appl. No.: 204,833

[22] Filed: Jun. 10, 1988

[51] Int. Cl.[4] ..... F02M 25/06

[52] U.S. Cl. ..... 123/568; 123/571

[58] Field of Search ..... 123/568, 569, 571; 137/907

[56] References Cited

U.S. PATENT DOCUMENTS

| | | | |
|---|---|---|---|
| 2,154,417 | 4/1939 | Anderson | 123/327 |
| 3,678,909 | 7/1972 | Barker et al. | 123/568 |
| 3,762,384 | 10/1973 | Day et al. | 123/568 |
| 3,820,514 | 6/1974 | Kuehl | 123/568 |
| 4,350,136 | 9/1982 | Yanagisawa | 123/568 |
| 4,351,285 | 9/1982 | Bradshaw | 123/568 |
| 4,566,423 | 1/1986 | Kenny et al. | 123/571 |
| 4,694,812 | 9/1987 | Wendt | 123/571 |

FOREIGN PATENT DOCUMENTS

| | | | |
|---|---|---|---|
| 2318917 | 10/1974 | Fed. Rep. of Germany | 123/568 |
| 2605358 | 5/1977 | Fed. Rep. of Germany | 123/568 |
| 0090756 | 5/1984 | Japan | 123/568 |

*Primary Examiner*—Willis R. Wolfe

*Attorney, Agent, or Firm*—C. K. Veenstra

[57] ABSTRACT

An exhaust gas recirculation valve has a seat formed in a member that is secured to the valve actuator independently of the valve base and that can accordingly accommodate a wide variety of base designs without substantial change in the equipment employed to assemble the valve.

2 Claims, 1 Drawing Sheet

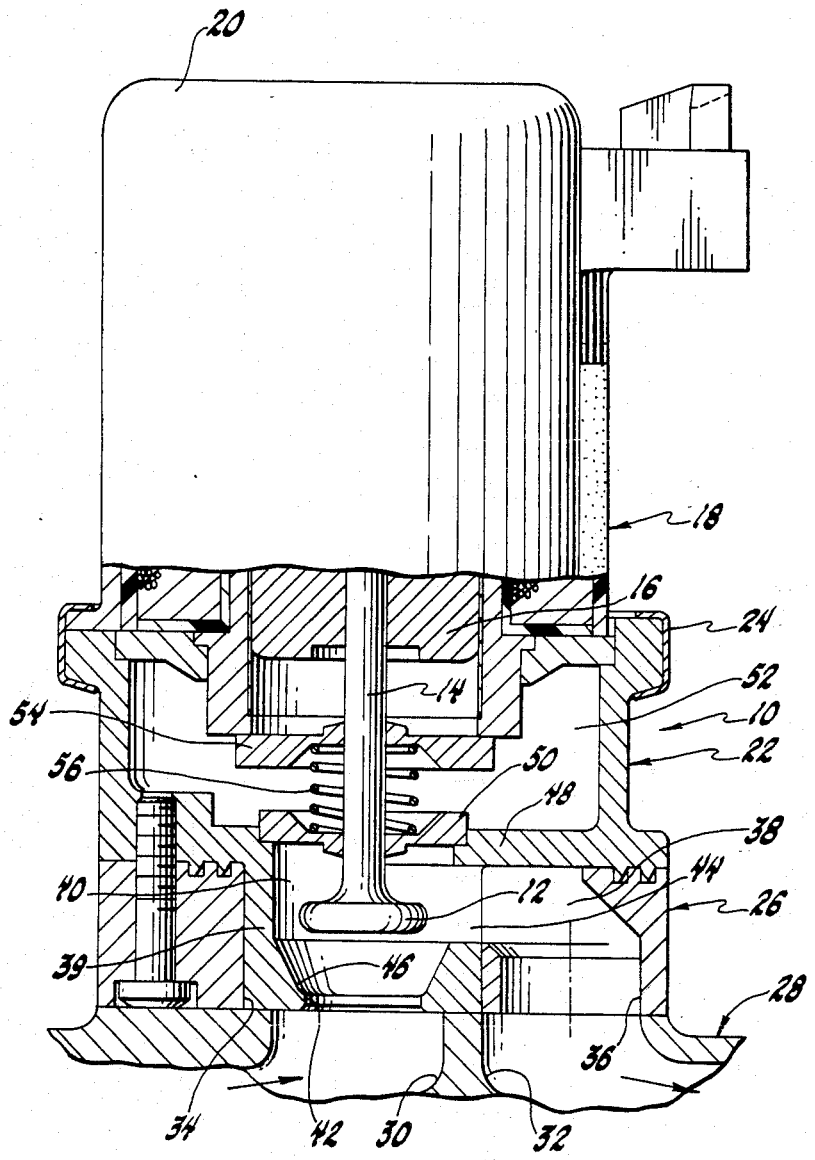
20
18
16
24
52
10
22
14
54
56
50
48
38
44
40
12
26
39
46
28
36
34
42
30
32

EXHAUST GAS RECIRCULATION VALVE

TECHNICAL FIELD

This invention relates to a valve for controlling recirculation of exhaust gases in an internal combustion engine.

BACKGROUND AND SUMMARY OF THE INVENTION

An exhaust gas recirculation (EGR) valve generally has a pintle positioned by an actuator to control recirculation of exhaust gases in an engine. The actuator retracts the pintle from a seat to increase recirculation of exhaust gases, and advances the pintle toward the seat to reduce recirculation of exhaust gases. The seat is incorporated in a base that mounts the EGR valve on the engine manifold. The EGR valve may be adaptable to a variety of engine manifolds by varying the actuator characteristics, the shape of the pintle and seat, and the design of the mounting base.

Variations in actuator characteristics and the shape of the pintle and seat usually may be accommodated without substantial change in the equipment employed to assemble EGR valves. However, variations in the design of the mounting base are not readily accommodated. Because the seat is incorporated in the base, the pintle and its actuator must be installed on the base in order to align the pintle with the seat.

Accordingly, EGR valves are assembled from the base up, and the assembly equipment has a pallet that receives the base during installation of the pintle and actuator. The assembly equipment places height and width restrictions on the design of the base, requires a change in the design of the pallet with a change in the design of the mounting base, and requires a change in the height of the tooling with a change in the height of the base.

This invention provides an EGR valve that allows variations in the design of an EGR valve mounting base to be accommodated without substantial change in the assembly equipment.

This new EGR valve has a seat formed in a member that is secured to the actuator independently of the base and that can accommodate a wide variety of base designs. With this new EGR valve, the assembly equipment may have a pallet to receive the seat member during installation of the pintle and actuator, and the base may be added in a separate operation. With this new EGR valve, therefore, the assembly equipment need not impose height and width restrictions on the design of the base, need not require a change in the design of the pallet with a change in the design of the base, and need not require a change in the height of the tooling with a change in the height of the base.

It will be appreciated that this new EGR valve may be assembled entirely independently of the base, may be used with a base integrated in the engine manifold, and may be warehoused without a base.

The details as well as other features and advantages of a preferred embodiment of this new EGR valve are set forth in the remainder of the specification and are shown in the drawing.

SUMMARY OF THE DRAWING

The sole FIGURE of the drawing is a sectional view of a preferred embodiment of this new EGR valve.

THE PREFERRED EMBODIMENT

Referring to the drawing, an EGR valve 10 has a pintle 12 carried on a stem 14 by the armature 16 of a linear motor or solenoid actuator 18. Actuator 18 is sandwiched between a bracket 20 and a seat member 22, and a band 24 clamps bracket 20 to member 22, thereby securing actuator 18 to seat member 22. A base 26 is secured beneath seat member 22 for mounting EGR valve 10 on an engine manifold 28.

Manifold 28 has a passage 30 that receives exhaust gases from the engine exhaust system and a passage 32 that leads exhaust gases to the engine induction system. Base 26 has a cylindrical aperture 34 aligned with passage 30 and an aperture 36 aligned with passage 32. A recess 38 in the top of base 26 connects aperture 34 to aperture 36.

Seat member 22 has a cylindrical projection 39 extending through recess 38 into aperture 34. Projection 39 has a cavity 40 with an orifice 42 opening through aperture 34 from passage 30 and a window 44 opening to recess 38. Exhaust gases thus may be recirculated from the engine exhaust system through passage 30, orifice 42, cavity 40, window 44, recess 38, aperture 36 and passage 32 to the engine induction system.

It will be appreciated, of course, that aperture 36 could be aligned with passage 30 and aperture 34 aligned with passage 32. Exhaust gases then would be recirculated from the engine exhaust system through passage 30, aperture 36, recess 38, window 44, cavity 40, orifice 42 and passage 32 to the engine induction system.

Pintle 12 cooperates with a seat 46 surrounding orifice 42 to control recirculation of exhaust gases. To increase recirculation of exhaust gases, actuator 18 retracts pintle 12 from seat 46, and to reduce recirculation of exhaust gases, actuator 18 advances pintle 12 toward seat 46.

Seat member 22 has a web portion 48 that covers recess 38, and a seal 50 surrounds stem 14 and engages web portion 48. The exhaust gas chamber defined by recess 38 and cavity 40 is thereby isolated from the air chamber 52 formed between actuator 18 and member 22. Another seal 54 isolates actuator 18 from air chamber 52, and a spring 56 biases seal 54 against actuator 18 and presses seal 50 into engagement with web portion 48.

Base 26 may have suitable lugs (not shown) to receive studs that secure base 26 to manifold 28.

EGR valve 10 may be assembled by supporting seat member 22 in a pallet during installation of pintle 12 and its actuator 18. Accordingly, EGR valve 10 may be assembled entirely independently of base 26, and base 26 may be added in a separate operation. With EGR valve 10, therefore, the assembly equipment need not impose height and width restrictions on the design of base 26, need not require a change in the design of the pallet with a change in the design of base 26, and need not require a change in the height of the tooling with a change in the height of base 26.

It will be appreciated that EGR valve 10 could be used with base 26 integrated into manifold 28, that is, with apertures 34 and 36 and recess 38 formed directly in manifold 28.

We claim:

1. An exhaust gas recirculation valve suitable for mounting in a base having a pair of apertures and a recess connecting said apertures, said valve comprising a seat member having a portion adapted for closing said recess and also having a projection adapted to be received in one of said apertures, said projection having a cavity with an orifice adapted to open through said one aperture and a window adapted to open to said recess to thereby define an exhaust gas flow path between said apertures, said seat member having a seat surrounding said orifice, said valve further comprising a pintle aligned with said seat and an actuator for positioning said pintle to control the flow of exhaust gases through said seat.

2. The combination of an exhaust gas recirculation valve and a base, said base having a pair of apertures and a recess connecting said apertures, said valve comprising a seat member having a portion closing said recess and also having a projection received in one of said apertures, said projection having a cavity with an orifice opening through said one aperture and a window opening to said recess to thereby define an exhaust gas flow path between said apertures, said seat member having a seat surrounding said orifice, said valve further comprising a pintle aligned with said seat and an actuator for positioning said pintle to control the flow of exhaust gases through said seat.

* * * * *